US010701771B2

(12) United States Patent
Dost et al.

(10) Patent No.: US 10,701,771 B2
(45) **Date of Patent: *Jun. 30, 2020**

(54) LED LUMINAIRE WITH CONSTANT CURRENT PER-MODULE CONTROL

(71) Applicant: SIGNIFY HOLDING B.V., Eindhoven (NL)

(72) Inventors: Isaac P. Dost, Syracuse, NY (US); Daniel S. Foster, Syracuse, NY (US); George Albert Dederich, Jamesville, NY (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/451,470

(22) Filed: Jun. 25, 2019

(65) Prior Publication Data

US 2019/0387589 A1 Dec. 19, 2019

Related U.S. Application Data

(63) Continuation of application No. 15/982,264, filed on May 17, 2018, now Pat. No. 10,334,676.

(60) Provisional application No. 62/507,405, filed on May 17, 2017.

(51) Int. Cl.

| | |
|---|---|
| ***H05B 45/00*** | (2020.01) |
| ***H05B 45/37*** | (2020.01) |
| ***H05B 45/46*** | (2020.01) |
| ***G05F 1/56*** | (2006.01) |

(52) U.S. Cl.

CPC ..... *H05B 45/00* (2020.01); *G05F 1/56* (2013.01); *H05B 45/37* (2020.01); *H05B 45/46* (2020.01)

(58) Field of Classification Search

None

See application file for complete search history.

(56) References Cited

U.S. PATENT DOCUMENTS

| | | | |
|---|---|---|---|
| 9,188,307 | B2 | 11/2015 | Casper et al. |
| 9,730,302 | B2 | 8/2017 | Vollmer et al. |
| 9,800,431 | B2 | 10/2017 | Vollmer et al. |
| 2010/0283322 | A1 | 11/2010 | Wibben |
| 2011/0148323 | A1 | 6/2011 | Yao et al. |
| 2013/0057163 | A1 | 3/2013 | Sutardja et al. |

OTHER PUBLICATIONS

LT3797—Triple Output LED Driver Controller, Linear Technology, downloaded from internet Mar. 19, 2017, http://www.linear.com/product/LT3797.

Kraft, Jon, "Convert a Buck Regulator into a Smart LED Driver, Including Dimming", Analog Dialogue 47-03, Mar. 2013.

*Primary Examiner* — Jany Richardson

(57) ABSTRACT

A lighting device includes multiple light emitting diode (LED) channels. Each LED channel is connected in parallel to an output rail of a power converter. The power converter may be a buck regulator. Each LED channel may include an LED string of one or more LEDs, a first transistor that is electrically connected between the LED string and ground, a second transistor that is electrically connected between the first transistor and ground, and a current sensing resistor that is electrically connected between the first transistor and the second transistor. This design provides for self-regulation of current across all LED channels when another LED channel is added to or deleted from the lighting device.

18 Claims, 4 Drawing Sheets

LED LUMINAIRE WITH CONSTANT CURRENT PER-MODULE CONTROL

RELATED APPLICATIONS AND CLAIM OF PRIORITY

This patent document is a continuation of and claims priority to U.S. provisional patent application Ser. No. 15/982,264, filed May 17, 2018, which in turn claims priority to U.S. provisional patent application No. 62/507,405, filed May 17, 2017. The disclosures of each priority application are fully incorporated into this document by reference.

BACKGROUND

As light emitting diode (LED) luminaires increase in popularity, there is an increased desire to improve their operation and reduce manufacturing costs. One way that this has been done involves the use of a buck regulator to drive the LEDs in a luminaire. A buck regulator can help drive LEDs at higher current levels, thus increasing the lumens-per-LED output, and optionally reducing overall manufacturing costs.

However, a problem with the use of buck regulators to drive LED luminaires is that they depend on series LED strings to function. When it is desired to skip an LED in a string (i.e., selectively operate the LEDs), existing systems may use transistors to bypass selected LEDs, or they may use multiple buck regulators. The use of transistors may be sufficient when only a single LED is bypassed, but bypassing multiple LEDs can cause catastrophic voltage transients across the remaining LEDs, resulting in complete failure of the LED string. This risk is increased when high frequency controls are required, as a quick shift in load becomes more likely. The use of multiple buck regulators increases the cost and complexity of the luminaire's control system.

This document describes methods and systems that are directed to solving at least some of the issues discussed above.

SUMMARY

In various embodiments, a lighting device includes light emitting diode (LED) channels, each of which is connected in parallel to an output rail of a power converter, such as a buck converter. At least one of the LED channels includes a string of one or more LEDs, a first transistor that is electrically connected between the LED string and ground, a second transistor that is electrically connected between the first transistor and ground, and a current sensing resistor that is electrically connected between the first transistor and the second transistor.

Optionally, the lighting device also may include the power converter. Optionally, power converter may be a DC-to-DC power converter configured to step down voltage while stepping up current from an input to the output rail.

Each LED string may include either a single LED or multiple LEDs connected together in series. The power converter also may include a feedback pin that is connected to each of the LED channels between the first transistor and the current sensing resistor of the LED channel.

Optionally, at least one of the transistors in each LED channel is an n-channel field effect transistor.

Optionally, each LED channel also may include a capacitor that is electrically connected to the output rail of the power converter and the second transistor. In addition or alternatively, a controller may be electrically connected to the first transistor and the second transistor across the current sensing resistor. Optionally, the lighting device may include multiple controllers, each of which is electrically connected to one or more of the LED channels.

In various embodiments, each LED channel of the lighting device is self-regulating such that when any LED channel is added to or removed from the device, the current passing across each active LED channel will adjust to be substantially the same across all of the active LED channels.

In various other embodiments, a lighting system includes a buck converter that includes a DC-to-DC power converter configured to step down voltage while stepping up current from an input to an output rail. The system includes various LED channels, each of which is connected in parallel to the output rail of the buck converter. At least one of the LED channels includes a string comprising one or more LEDs, a first transistor that is electrically connected between the LED string and ground, and a second transistor that is electrically connected between the first transistor and ground. Optionally, each of the LED channels may include a current sensing resistor that is electrically connected between the first transistor and the second transistor of the LED channel. Optionally, the system may include one or more controllers, each of which is electrically connected to the first transistor and the second transistor of one or more of the LED channels across the current sensing resistor of the corresponding LED channel(s). Each LED channel may be self-regulating such that when any LED channel is added to or removed from the device, the current passing across each active LED channel will adjust to be substantially the same across all of the active LED channels.

In various other embodiments, a lighting system includes a buck converter that includes a DC-to-DC power converter configured to step down voltage while stepping up current from an input to an output rail. The system also includes LED channels, each of which is connected in parallel to the output rail of the buck converter. At least one of the LED channels includes an LED string of one or more LEDs. The system also includes one or more controllers, each of which is electrically connected to one or more of the LED channels.

DETAILED DESCRIPTION

Terminology that is relevant to this disclosure includes:

In this document, the singular forms "a," "an," and "the" include plural references unless the context clearly dictates otherwise. The term "comprising" means "including, but not limited to." Similarly, the term "comprises" means "includes, and is not limited to." Unless defined otherwise, all technical and scientific terms used in this document have the same meanings as commonly understood by one of ordinary skill in the art.

In this document, the terms "lighting device," "light fixture," "luminaire" and "illumination device" are used interchangeably to refer to a device that includes a source of optical radiation such as one or more light emitting diodes (LEDs), light bulbs, ultraviolet light or infrared sources, or other sources of optical radiation. A lighting device will also include a housing, one or more electrical components for conveying power from a power supply to the device's optical radiation source, and optionally control circuitry. An "LED luminaire" is a lighting device that includes LEDs as an optical radiation source.

In this document, the terms "controller" and "controller device" mean an electronic device or system of devices configured to command or otherwise manage the operation of one or more other devices. For example, a fixture controller is a controller configured to manage the operation of one or more light fixtures to which the fixture controller is communicatively linked. An LED controller is a controller that is configured to operate one or more LEDs of one or more LED luminaires. A controller will typically include a processing device, and it will also include or have access to a memory device that contains programming instructions configured to cause the controller's processor to manage operation of the connected device or devices.

In this document, the term "electrically connected" means, with respect to two or more components, that a conductive path exists between the components so that electric current can flow from one of the components to the other, either directly or through one or more intermediary components.

Figure 1:
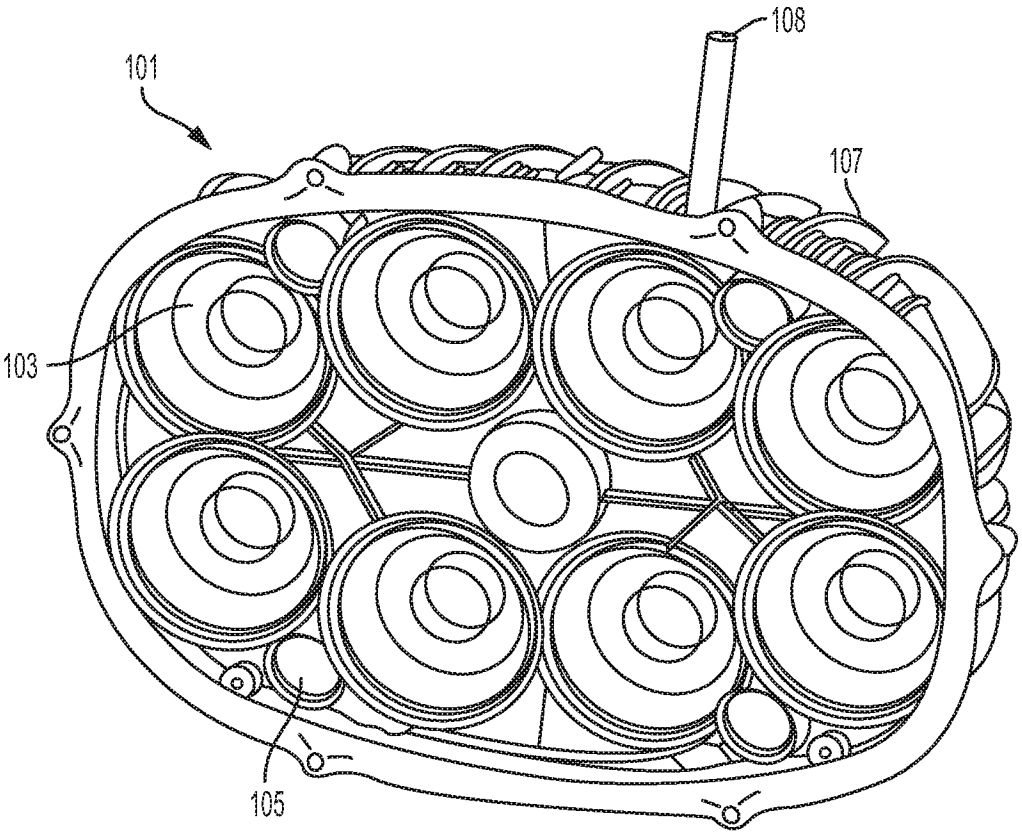
FIG. 1 PRIOR ART
FIG. 1 illustrates an example LED luminaire such as may exist in the prior art.

Referring to FIG. 1, an example lighting device 101 such as that which may exist in the prior art may include an optical radiation source, such as any number of lighting modules that include LEDs. In various embodiments lighting device 101 will include a number of LED modules sufficient to provide a high intensity LED device. In some embodiments, the lighting device may include multiple types of LED modules. For example, a lighting device may include a first type of LED module 103 having LEDs that are configured to selectably emit white light of various color temperatures, along with a second type of LED module 105 having LEDs that are configured to selectably emit light of various colors. The lighting device 101 may include a housing 107 that holds electrical components such as a fixture controller, a power source, and wiring and circuitry to supply power and/or control signals to the LED modules. The lighting device 101 also may include communication components 108 such as a transceiver and antenna.

Figure 2:
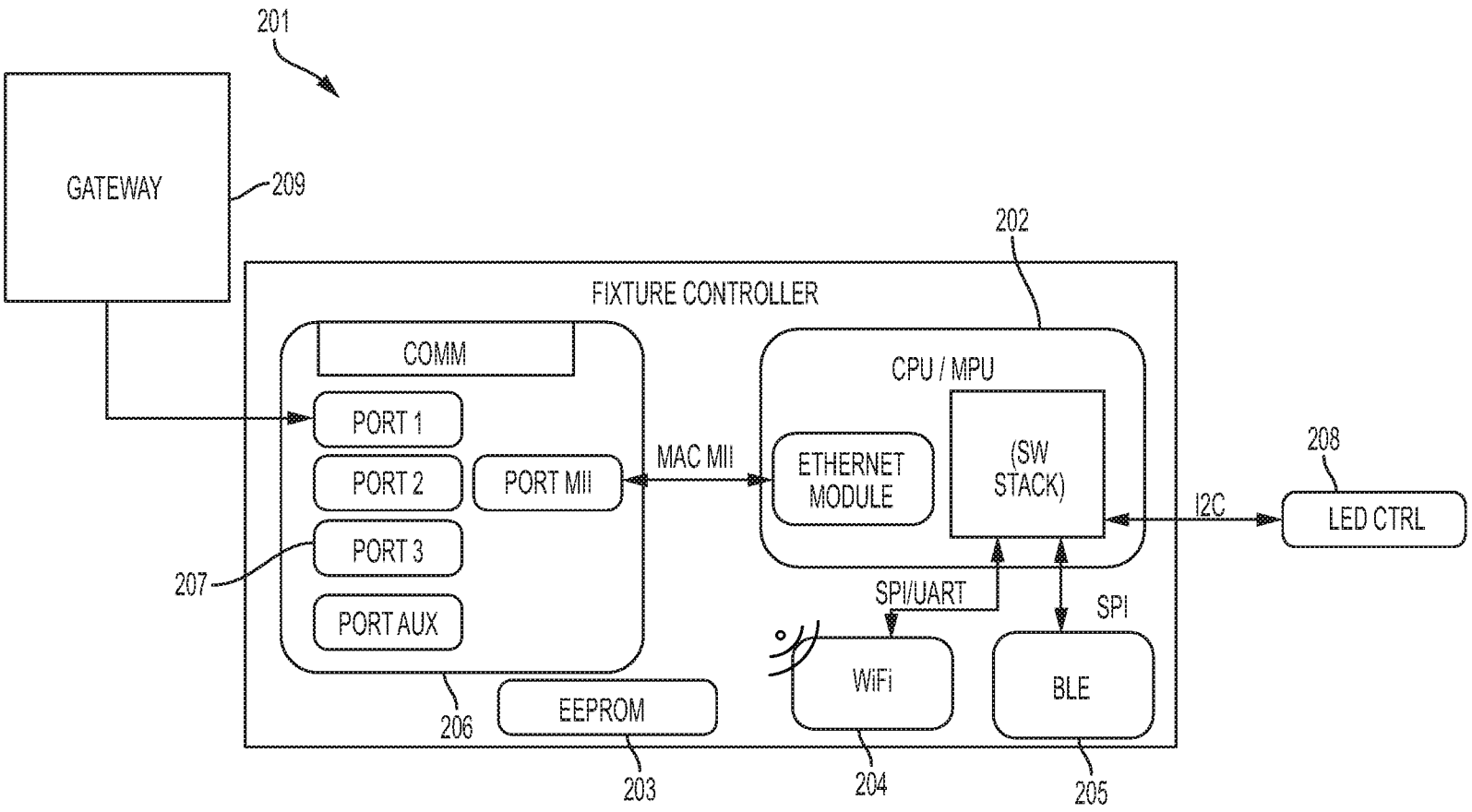
FIG. 2 illustrates an example fixture controller.

The lighting device and/or LED modules or subsets of LEDs within the modules may be controlled by one or more fixture controllers. A fixture controller may be an external device or an integral device that includes various components of an illumination device's control circuitry. Example components of a fixture controller 201 are shown in FIG. 2. A fixture controller 201 will include a processor 202 and memory device 203 containing programming and/or data that the processor 202 uses to selectively control the LED modules 208 or other optical radiation source of the lighting device.

The fixture controller 201 will include any number of communication interfaces, such as a Wi-Fi antenna 204, a short-range communication or NFC transceiver 205, and/or a wired communication interface 206 containing any number of ports 207 via which other lighting devices, controllers or other devices may be connected to the fixture controller's lighting device. For example, a gateway controller 209 may be connected to the fixture controller 201 via any of the ports 207. The gateway controller may include a processor and a communications interface that includes a router or switch with one or more Ethernet ports or optical fiber connectors configured to receive an Ethernet and/or fiber-optic cable. Other types of cables and connectors may be used, but for purposes of this disclosure, Ethernet and fiber-optic cables and connectors will be used as examples. Fixture controllers such as those shown in FIG. 2 may be used to control the intensity, luminance, color temperature, color, Duv, or other characteristics of light emitted by LED modules, or by LED strings within modules. Thus, fixture controllers may be considered LED controllers as will be discussed below in the context of the discussion of FIG. 4. The fixture controller(s) may be part of a device, or they may be communicatively and/or electrically connected to the lighting device and thus part of a system that includes the lighting device, the fixture controller and optionally other components.

Figure 3:
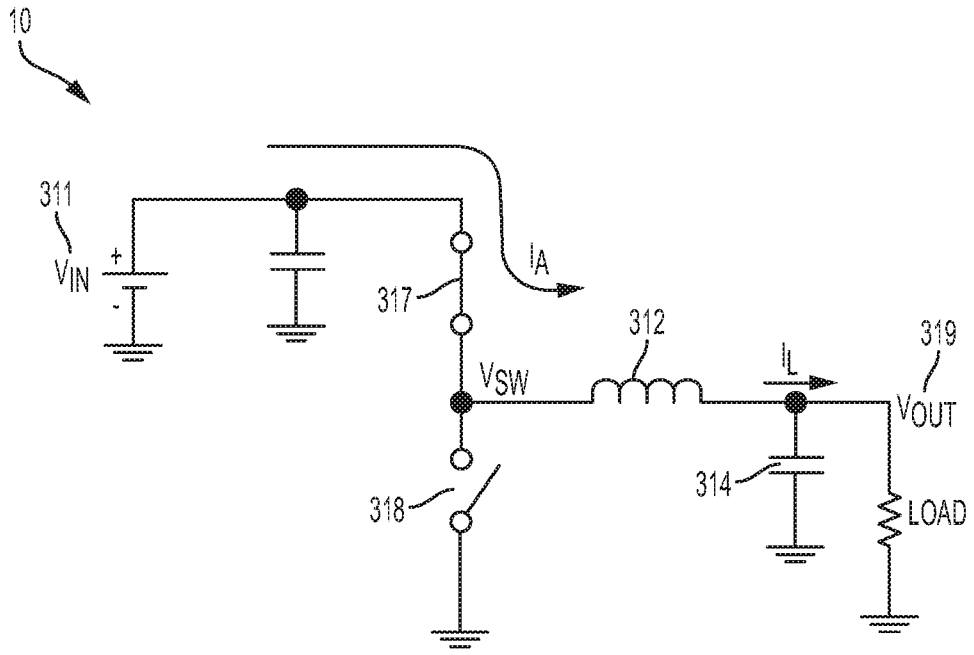
FIG. 3 illustrates a buck regulator of a type that may exist in the prior art.

The lighting device will also include a power supply and circuitry that regulates the voltage delivered to the LED modules. A buck regulator (sometimes referred to as a buck converter or buck driver) is an electronic device that steps down an input voltage and passes it through an LC filter or other circuit to increase current and provide a stable output. A buck regulator can function as a DC-to-DC power converter configured to step down voltage while stepping up current from an input to an output rail. An example buck regulator 10 of the prior art is illustrated in FIG. 3. It includes two active elements and two passive elements. The active elements include two switches: a first switch 317 between the input 311 and an inductor 312, and a second switch 318 between ground and the inductor 312. The passive elements are the inductor 312 and the output capacitor 314, which together form the LC filter. Switches 317 and 318 may be diodes, transistors or other switching devices. Switches 317 and 318 may alternate between open and closed positions via pulse width modulation, with one of the switches always remaining closed when the other is open. Current will flow through path $I_A$ when switch 317 is closed and switch 318 is open. When switch 318 is closed and switch 317 is open, current will flow from ground through the LC filter to the output rail 319.

The inventors have developed a control system for LED luminaires in which a single buck driver can power multiple, individually controlled LED strings in parallel while maintaining substantially the same current across each of the LED strings. Operating the LED strings in parallel can allow for a lower rail voltage (which is useful with a buck driver, which steps down input voltage). Rapidly changing the load changes the required current delivered by the driver, while the voltage remains substantially the same regardless of load. Thus, the embodiments described in this document may allow the use of a smaller inductor and larger output capacitor, which can together yield a faster transient response. Certain embodiments discussed below also allow for individual string snubber circuitry to be added if necessary to provide additional protection against transients if desired.

Figure 4:
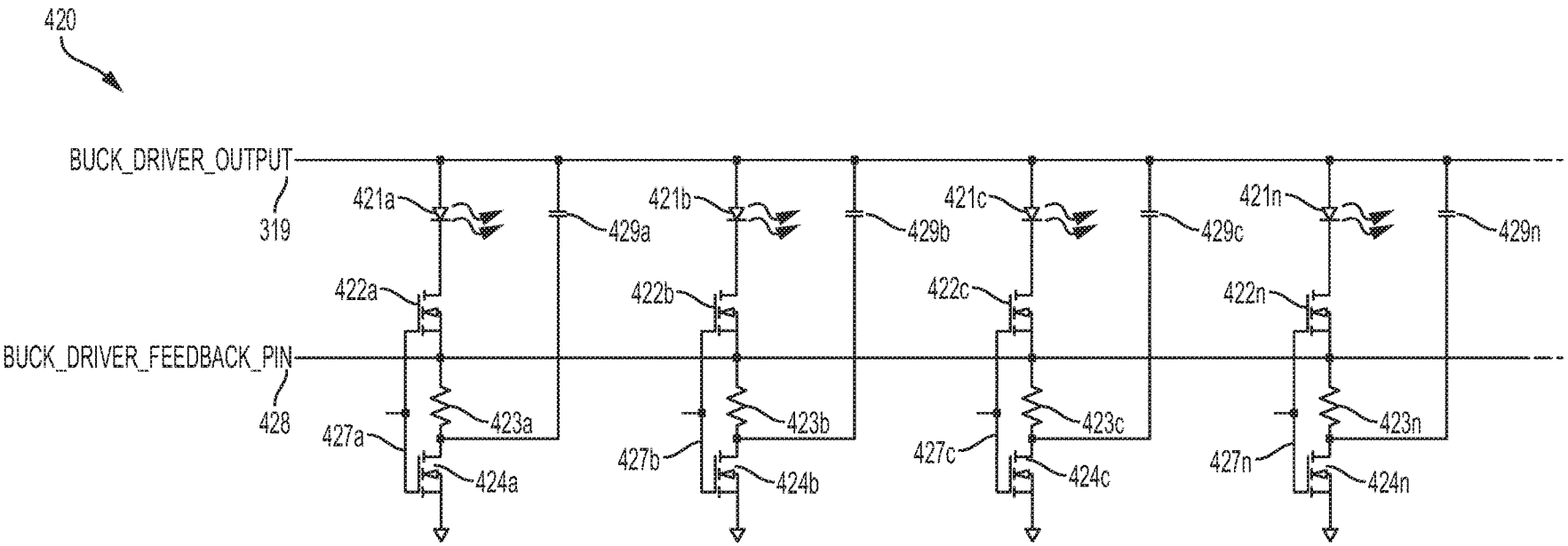
FIG. 4 illustrates an embodiment of a self-regulating configuration of LED channels in a luminaire.

FIG. 4 illustrates the circuitry that such a control system 420 may employ. A set of LED strings 421*a* . . . 421*n* are electrically connected in parallel to a common buck driver output rail 319. (For ease of reading, from this point forward this document will refer to each repeatable element shown in FIG. 4 simply by its "# n" reference number.) The buck driver output rail 319 may be that of a buck driver such as that shown in FIG. 3. Each LED string 421*n* may be a single LED as shown, or it may include two or more LEDs connected in series. Each LED string 421*n* is part of a channel (i.e., a circuit) that runs from the output rail of the buck driver 319 to a first transistor 422*n*. In various embodiments, the first transistor 422*n* may be an N-channel field effect transistor (FET) or another type of low-side voltage controlled switch. In each LED circuit, the first transistor 422*n* will sink the LED current through a current sensing resistor 423*n* to a second transistor 424*n* (which again may be an N-channel FET or other low-side voltage controlled switch).

The LED controller 427*n* for each LED string will be connected to each of the transistors 422*n*, 424*n* across the current sensing resistor 423*n* for that LED string. Each time a controller 427*n* provides a signal that switches its connected transistors 422*n*, 424*n* on, the second transistor 424*n* will pull the current from the LED string 421*n* to ground across the first transistor 422*n* and current sensing resistor 423*n*.

In this way, when an LED channel is added, the current sensing resistor of that string will be pulled in parallel with the other active LED channels' current sensing resistors, thus increasing the total current being supplied by the buck driver to account for the additional LED channel. In a similar way, when an LED channel is deleted, the current sensing resistor of the remaining active LED channels will be pulled in parallel with each other, thus decreasing the total current being supplied by the buck driver to account for the removal of an LED channel. The system therefore self-regulates whenever an LED channel is added or removed so that a substantially constant current remains across each LED channel.

The buck driver's feedback pin 428 may be connected to each LED channel between the first transistor 422*n* and the current sensing resistor 423*n*. With this connection, the first transistor 422*n* in each channel also pulls the LED current to the buck driver's feedback input pin 428 so that the buck driver can regulate the voltage delivered to the system. With a single channel (and a single current sensing resistor), the output current would flow over the current sensing resistor, creating voltage on the feedback pin, so that the buck driver will regulate the voltage to yield a corresponding regulation of the output current. With multiple channels (and thus multiple current sensing resistors) in parallel, the same principle applies, but the buck driver will regulate the total current over all channels.

Optionally, each LED channel may include a capacitor 429*n* that is connected between the rail of the buck driver output rail 319 and the drain of the second transistor 424*n*. The capacitor 429*n* serves as a snubber to suppress voltage spikes that may be caused when the circuit or another comes online or goes offline. This allows for additional transient protection for each LED string. The snubber may also reduce the needed storage capacitance of the buck driver, this allowing for a faster load transient response. In order words, the snubbers provide each LED string with its own storage capacitance that will only be used if the string is on. Optionally, each snubber also may include a resistor (not shown) in series with the capacitor 429*n*.

The embodiments contemplated this document are not limited to luminaires or systems that use a single buck driver. Multiple buck drivers may be used, so long as at least some of the buck drivers are used to control multiple LED strings in parallel as discussed above.

The embodiments described above may be installed and included in the circuitry of an individual luminaire. Alternatively, some of the components, such as the buck driver and/or controller, may be part of a control system that is external to the luminaire. Examples of luminaires and control systems that the embodiments disclosed above may be used in include, for example, those described in U.S. Pat. No. 9,188,307, titled "High Intensity LED Illumination Device with Automated Sensor-Based Control"; U.S. Pat. No. 9,730,302, titled "System and Method for Control of Illumination Device"; and U.S. Pat. No. 9,800,431, titled "Controllers for Interconnected Lighting Devices", the disclosures of which are all fully incorporated into this document by reference.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A lighting device, comprising:

a plurality of light emitting diode (LED) channels, each of which is connected in parallel to an output rail of a power converter, and at least one of which comprises:

an LED string comprising one or more LEDs, a first switch that is electrically connected between the LED string and ground, a second switch that is electrically connected between the first switch and ground, and a current sensing resistor that is electrically connected between the first switch and the second switch.

2. The lighting device of claim 1, further comprising the power converter, which comprises a DC-to-DC power converter configured to step down voltage while stepping up current from an input to the output rail.

3. The lighting device of claim 1, wherein the power converter comprises a buck converter.

4. The lighting device of claim 1, wherein each LED string comprises a plurality of LEDs connected together in series.

5. The lighting device of claim 1, wherein the power converter further comprises a feedback pin that is connected to each of the LED channels between the first switch and the current sensing resistor of the LED channel.

6. The lighting device of claim 1, wherein each LED channel further comprises a capacitor that is electrically connected to the output rail of the power converter and the second switch of the LED channel.

7. The lighting device of claim 1, further comprising a controller that is electrically connected to the first switch and the second switch of each LED channel across the current sensing resistor of the LED channel.

8. The lighting device of claim 1, further comprising a plurality of controllers, each of which is electrically connected to one or more of the LED channels.

9. The lighting device of claim 1, wherein each LED channel is self-regulating such that when any LED channel is added to or removed from the device, current passing across each active LED channel will adjust to be substantially the same across all active LED channels.

10. The lighting device of claim 1, wherein at least one of the switches comprises a voltage controlled switch.

11. A lighting system, comprising:

a buck converter that comprises a DC-to-DC power converter configured to step down voltage while stepping up current from an input to an output rail;

a plurality of light emitting diode (LED) channels, each of which is connected in parallel to the output rail of the buck converter, and at least one of which comprises:

an LED string comprising one or more LEDs, a first switch that is electrically connected between the LED string and ground, and a second switch that is electrically connected between the first switch and ground, and a current sensing resistor that is electrically connected between the first switch and the second switch of the LED channel.

12. The lighting system of claim 11, wherein each LED string comprises a plurality of LEDs connected together in series.

13. The lighting system of claim 11, wherein the buck converter further comprises a feedback pin that is connected to each of the LED channels between the first switch and the current sensing resistor of the LED channel.

14. The lighting system of claim 11, wherein each LED channel further comprises a capacitor that is electrically connected to the output rail of the buck converter and the second switch.

15. The lighting system of claim 11, further comprising a controller that is electrically connected to the first switch and the second switch of each LED channel across the current sensing resistor of the LED channel.

16. The lighting system of claim 11, further comprising a plurality of controllers, each of which is electrically connected to one or more of the LED channels.

17. The lighting system of claim 11, wherein each LED channel is self-regulating such that when any LED channel is added to or removed from the device, current passing across each active LED channel will adjust to be substantially the same across all active LED channels.

18. The lighting system of claim 11, wherein at least one of the switches comprises a voltage controlled switch.

* * * * *